US005192468A

United States Patent [19]

Coates et al.

[11] Patent Number: 5,192,468

[45] Date of Patent: Mar. 9, 1993

[54] PROCESS FOR FLASH SPINNING FIBER-FORMING POLYMERS

[75] Inventors: Don M. Coates, Midlothian; Carl K. McMillin, Richmond, both of Va.; John C. Chen, Hockessin, Del.

[73] Assignee: E. I. Du Pont de Nemours and Company, Wilmington, Del.

[21] Appl. No.: 688,017

[22] Filed: Apr. 19, 1991

Related U.S. Application Data

[63] Continuation-in-part of Ser. No. 602,344, Oct. 23, 1990, abandoned, which is a continuation-in-part of Ser. No. 440,156, Nov. 22, 1989, abandoned.

[51] Int. Cl.[5] ..... B29B 9/00

[52] U.S. Cl. ..... 264/13; 264/205; 264/211; 264/211.14

[58] Field of Search ..... 264/13, 205, 211, 211.14, 264/517, 518

[56] References Cited

U.S. PATENT DOCUMENTS

| | | | |
|---|---|---|---|
| 3,081,519 | 3/1963 | Blades et al. | 57/248 |
| 3,169,899 | 2/1965 | Steuber | 428/198 |
| 3,227,794 | 1/1966 | Anderson et al. | 264/205 |
| 3,987,139 | 10/1976 | Kozlowski et al. | 264/141 |
| 4,007,247 | 2/1977 | Ballard et al. | 264/140 |
| 4,082,887 | 4/1978 | Coates | 428/289 |
| 5,009,820 | 4/1991 | Coates et al. | 264/13 |

FOREIGN PATENT DOCUMENTS

| | | |
|---|---|---|
| 0431801 | 6/1991 | European Pat. Off. . |
| 1450892 | of 1976 | United Kingdom . |

OTHER PUBLICATIONS

P. S. Zurer, "Search Intensifies for Alternatives to Ozone-Depleting Halocarbons," Chem. & Eng. News, pp. 17-20 (Feb. 8, 1988).

*Primary Examiner*—Leo B. Tentoni

[57] ABSTRACT

The invention relates to a process for flash-spinning plexifilamentary film-fibril strands of polymers that are substantially plasticizable in carbon dioxide and/or water and have a melting point less than 300° C. More particularly, the strands are flash-spun from mixtures of carbon dioxide, water and the polymer. The invention also relates to the film-fibril strands produced by the inventive process.

12 Claims, No Drawings

PROCESS FOR FLASH SPINNING FIBER-FORMING POLYMERS

CROSS REFERENCE TO RELATED APPLICATIONS

This application is a continuation-in-part of application Ser. No. 07/602,344 filed Oct. 23, 1990, now abandoned, which is in turn a continuation-in part of application Ser. No. 07/440,156 filed Nov. 22, 1989, now abandoned.

FIELD OF THE INVENTION

The invention relates to a process for flash-spinning plexifilamentary film-fibril strands of polymers that are substantially plasticizable in carbon dioxide and/or water, and have a melting point less than 300° C. More particularly, the invention relates to plexifilamentary film-fibril strands that are flash-spun from mixtures of carbon dioxide, water and the polymer.

BACKGROUND OF THE INVENTION

Blades and White, U.S. Pat. No. 3,081,519 describe flash-spinning plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash spinning causes the liquid to vaporize and thereby cool the extrudate which forms a plexifilamentary film-fibril strand of the polymer. According to Blades and White, the following liquids are useful in the flash-spinning process: aromatic hydrocarbons such as benzene, toluene, etc.; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as methylene chloride, carbon tetrachloride, chloroform, ethyl chloride, methyl chloride; alcohols; esters; ethers; ketones; nitriles; amides; fluorocarbons; sulfur dioxide; carbon disulfide; nitromethane; water; and mixtures of the above liquids. The patent further states that the flash-spinning solution additionally may contain a dissolved gas, such as nitrogen, carbon dioxide, helium, hydrogen, methane, propane, butane, ethylene, propylene, butene, etc. Preferred for improving plexifilament fibrillation are the less soluble gases, i.e., those that dissolve to a less than 7% concentration in the polymer solution under the spinning conditions.

Blades and White state that polymers which may be flash spun include those synthetic filament-forming polymers or polymer mixtures which are capable of having appreciable crystallinity and a high rate of crystallization. A preferred class of polymers is the crystalline, non-polar group consisting mainly of crystalline polyhydrocarbons, such as polyethylene and polypropylene.

U.S. Pat. No. 3,169,899 lists polyester, polyoxymethylene, polyacrylonitrile, polyamide, polyvinyl chloride, etc. as other polymers that may be flash spun. Still other polymers mentioned in the patent are flash spun as mixtures with polyethylene, including ethylene vinyl alcohol, polyvinyl chloride, polyurethane, etc. Example 18 of U.S. Pat. No. 3,169,899 illustrates flash spinning from methylene chloride of a mixture of polyethylene and ethylene vinyl alcohol in which polyethylene is the predominant component of the polymer mixture.

Flash spun polyethylene products have achieved considerable commercial success. "TYVEK ®" spunbonded olefin is a spunbonded polyethylene sheet product sold by E. I. du Pont de Nemours and Company. These sheets are used in the construction and packaging industries. "TYVEK ®" spunbonded olefin is also used in protective apparel since the flash spun product provides a good barrier to particulate penetration. However, the hydrophobic nature of polyethylene results in a garment which tends to be uncomfortable during hot, humid weather. A more hydrophilic flash spun product is clearly desirable for garment and some other end uses. Additionally, flash spinning of any of the polymers would preferably be achieved from an environmentally safe, non-toxic solvent.

Trichlorofluoromethane ("FREON ®-11) has been a very useful solvent for commercial manufacture of plexifilamentary film-fibril strands of polyethylene. However, the escape of such a halocarbon into the atmosphere has been implicated as a serious source of depletion of the earth's ozone. A general discussion of the ozone-depletion problem is presented, for example by P. S. Zurer, "Search Intensifies for Alternatives to Ozone-Depleting Halocarbons", *Chemical & Engineering News*, pages 17–20 (Feb. 8, 1988). The substitution of environmentally safe solvents for trichlorofluoromethane in a commercial flash spinning process should minimize the ozone depletion problem.

There now has been discovered in accordance with this invention, flash spun polymer products desirable for uses such as garments, construction and packaging, which are flash spun from an environmentally acceptable mixture comprising carbon dioxide and water.

SUMMARY OF THE INVENTION

There is provided by this invention a process for flash spinning plexifilamentary film-fibril strands of a fiber-forming polymer that is substantially plasticizable in carbon dioxide and/or water, and has a melting point less than 300° C., comprising the steps of forming a spin mixture of water, carbon dioxide and the polymer at a temperature of at least 130° C., at a pressure that is greater than the autogenous pressure of the mixture and then flash spinning the mixture into a region of substantially lower temperature and pressure. Also provided by this invention is the plexifilamentary film-fibril strand produced by the process of this invention.

Preferably, the polymer is a polyolefin selected from the group consisting of polyethylene, polypropylene, ethylene vinyl alcohol copolymers and combinations thereof. An especially desirable combination is polyethylene with ethylene vinyl alcohol to which is grafted about 10% by weight of a high density polyethylene.

As used herein, the terms "substantially plasticizable" mean that the polymers are softened and become less viscous by imbibbing the carbon dioxide and/or water.

DETAILED DESCRIPTION OF THE PREFFERED EMBODIMENTS

The term "plexifilamentary film-fibril strand" or simply "plexifilamentary strand", as used herein, means a strand which is characterized as a three-dimensional integral network of a multitude of thin, ribbon-like, film-fibril elements of random length and of less than about 4 microns average thickness, generally coextensively aligned with the longitudinal axis of the strand.

The film-fibril elements intermittently unite and separate at irregular intervals in various places throughout the length, width and thickness of the strand to form the three-dimensional network. Such strands are described in further detail by Blades and White, U.S. Pat. No. 3,081,519 and by Anderson and Romano, U.S. Pat. No. 3,227,794.

Polymers particularly useful in the practice of this invention are polyethylene, polypropylene, grafted and ungrafted copolymers of ethylene and vinyl alcohol (hereinafter sometimes referred to as "EVOH"), graft copolymers of acrylic acid, polyurethane, and combinations thereof. The copolymers of ethylene and vinyl alcohol have a copolymerized ethylene content of about at least 20 mole %. The ethylene vinyl alcohol copolymer may include as an optional comonomer other olefins such as propylene, butene-1, pentene-1, or 4-methylpentene-1 in such an amount as to not change the inherent properties of the copolymer, generally in an amount of up to about 5 mole %, based on the total copolymer. The melting points of these ethylene vinyl alcohol polymers are generally between about 160° and 190° C. Ethylene vinyl alcohol polymers are normally prepared by copolymerization of ethylene with vinyl acetate followed by saponification of the acetate groups to the hydroxyl groups. At least about 90% of the acetate groups should by saponified, this being necessary to achieve sufficient mixing of the polymer. This process is well known in the art.

A particularly advantageous EVOH polymer can be prepared by grafting long chains of polyethylene or polypropylene (i.e., blocks), onto the random ethylene vinyl alcohol copolymer. The grafting process is accomplished by properly mixing EVOH and a pendant anhydride containing polyolefins in the molten state under shear through either a batch or continuous mixing device (e.g., haake mixer or extruder). The grafted polymers appear to be more compatible with additional polyolefins used in most of the flash spinning experiments. A polyolefin graft level of 5–50% by weight is most useful.

The process requires forming a spin mixture of the polymer, water and carbon dioxide. The water is present in the range from 5 to 50 percent based on the total weight of the spin mixture. The carbon dioxide is present in the range from 30 to 90 percent based on the total weight of the spin mixture. The polymer is present in the range from 1.5 to 25 percent based on the total weight of the spin mixture.

As noted above, the spin mixture may also comprise ethylene vinyl alcohol copolymer and an additional polymer present in the range from 0 to 25 percent based on the total weight of the spin mixture. Conveniently, polyethylene and polypropylene are the preferred additional polymers.

The spinning mixture may optionally contain a surfactant. The presence of such a surfactant appears to assist in emulsifying the polymer, or in otherwise aiding in forming a mixture. Examples of suitable nonionic surfactants are disclosed in U.S. Pat. No. 4,082,887, the contents of which is herein incorporated by reference. Among the suitable, commercially available, nonionic surfactants are the "Spans", which are mixtures of the esters of the monolaurate, monooleate and monostearate type and the "Tweens", which are the polyoxyethylene derivatives of these esters. The "Spans" and the "Tweens" are products of ICI Americas, Wilmington, Del.

The required temperatures for preparing the spin mixture and for flash-spinning the mixture are usually about the same and usually are in the range of 130° to 275° C. The mixing and the flash-spinning are performed at a pressure that is higher than the autogenous pressure of the mixture. The pressure during the spin mixture preparation is generally in the range from 1,200 to 6,000 psi.

Conventional flash-spinning additives can be incorporated into the spin mixtures by known techniques. These additives can function as ultraviolet-light stabilizers, antioxidants, fillers, dyes, surfactants and the like.

EXAMPLES

Equipment

Two autoclaves were used in the following non-limiting examples. One autoclave, designated a "300cc" autoclave (Autoclave Engineers, Inc., Erie, Pa.) was equipped with a turbine-blade agitator, temperature and pressure measuring devices, heating means, a means of pumping in carbon dioxide under pressure and inlets for loading the ingredients. An exit line from the bottom of the autoclave was connected through a quick-acting valve to a spin orifice 0.079 cm in diameter. The spin orifice had a length to diameter ratio of 1 with a tapered conical entrance at an angle of 120 degrees. The second autoclave, designated a "1 gallon" autoclave (again made by Autoclave Engineers, Inc.), was equipped in an analogous manner to that of the "300cc" autoclave.

Test Procedures

The surface area of the plexifilamentary film-fibril strand product is a measure of the degree and fineness of fibrillation of the flash-spun product. Surface area is measured by the BET nitrogen absorption method of S. Brunauer, P. H. Emmett and E. Teller, *Journal of American Chemical Society*, Vol. 60, pp. 309–319 (1938) and is reported as $m^2/g$.

Tenacitt and elongation of the flash-spun strand are determined with an Instron tensile-testing machine. The strands are conditioned and tested at 70.F and 65% relative humidity. The strands are then twisted to 10 turns per inch and mounted in the jaws of the Instron Tester. A 1-inch gauge length and an elongation rate of 60% per minute are used. The tenacity at break is recorded in grams per denier (gpd).

The denier of the strand is determined from the weight of a 15 cm sample length of strand.

In the non-limiting examples which follow, all parts and percentages are by weight unless otherwise indicated. The conditions of all Examples are summarized in Table I.

EXAMPLE 1

The "300 cc" autoclave was loaded in sequence with 7 g of an ethylene vinyl alcohol copolymer, 43 g crushed ice and 50 g crushed solid carbon dioxide. The copolymer contained 30 mole % ethylene units, had a melt flow rate of 3 g/10min by standard techniques at a temperature of 210° C. and a pressure of 2.16 kg, a melting point of 183° C. and a density of 1.2 g/cc. The resin was a commercially available product from E. I. du Pont de Nemours and Company, Wilmington, Del. sold as SELAR ® 3003.

The autoclave was closed and the vessel was pressurized to 850 psi (5861 kPa) with liquid carbon dioxide for 5 minutes while stirring until the mixture reached room temperature (24° C.). The amount of carbon dioxide added was then obtained from the difference of volumes (the densities of the polymer (1.2 g/cc), water (1.0 g/cc) and liquid carbon dioxide (0.72 g/cc) at 24° C. assuming complete filling of the autoclave. The amount of carbon dioxide added to this point was 166 g. The stirrer was rotated at 2000 rpm, and heating was begun. When the temperature of the contents of the autoclave reached 175° C., the internal pressure was adjusted by venting approximately 10% of the carbon dioxide and 10% of the water to reduce the pressure to 2500 psi (17,238 kPa). The spin mixture, after venting, contained 3.6% ethylene vinyl alcohol copolymer, 19.8% water and 76.6% carbon dioxide as shown in Table I. The stirring was continued for 30 minutes at a temperature of 175° C. and a pressure of 2500 psi. Agitation was stopped followed by prompt opening of the exit valve to permit the mixture to flow to the spin orifice which also had been heated to 175° C. The mixture was flash spun and collected.

Scanning Electron Microscopy (SEM) revealed a finely fibrillated continuous plexifilamentary strand. The strand was noticably elastomeric and had recovery properties.

EXAMPLE 2

The procedure of Example 1 was followed except that an ethylene vinyl alcohol copolymer was used with 44 mole % ethylene units. The 44 mole % copolymer was obtained from E. I. du Pont de Nemours and Company, Wilmington, Del. as SELAR® 4416. It had a melt flow rate of 16 g/10 min (210° C., 2.16 kg) a melting point of 168° C. and a density of 1.15 g/cc. The result as determined by SEM was a finely fibrillated plexifilamentary strand. The strand was noticably elastomeric and was similar in appearance to the strand of Example 1.

EXAMPLE 3

The procedure of Example 2 was followed except that the spin pressure was 2550 psi. The result again was an elastomeric plexifilamentary strand. SEM analysis showed the strand to be coarser than the strand of Example 2.

EXAMPLE 4

The procedure of Example 1 was followed except that the polymer concentration was increased and the spin pressure was 3300 psi. The result was a strand similar to that of Example 3.

EXAMPLE 5

The procedure of Example 1 was followed except that the spin pressure was 3500 psi and 0.5%, based on the total weight of the spin mixture, high density polyethylene (HDPE) was added to the mixture. The polyethylene used has a melt index of ca. 0.8, and is commercially available from Occidental Chemical Corporation of Houston, Tex. as ALATHON® 7026A. The result was a high quality finely fibrillated plexifilamentary strand. The strand was elastomeric but less so than the strand of Example 1.

EXAMPLE 6

The procedure of Example 5 was followed except that the amount of polyethylene was increased. The result as determined by SEM was a continuous finely fibrillated strand of slightly more coarse fibrillation than the strand of Example 5. The strand showed a further loss in elastomeric properties over the strand of Example 5.

EXAMPLE 7

The procedure of Example 5 was followed except that the amount of polyethylene was further increased. SEM analysis revealed a coarse plexifilamentary strand. The strand had no elastomeric properties.

EXAMPLE 8

The procedure of Example 1 was followed with the various component changes as shown in Table I. In this example, 2 g of a nonionic surfactant mixture containing 65% by weight "Span" 80 and 35% by weight "Tween" 80 was added to the spin mix. The autoclave was not vented in this example, but was allowed to reach the spin pressure by heating and holding the temperature at 177° C. The result was a continuous, somewhat coarsely fibrillated mat of plexifilamentary fibers. The fibers were elastomeric.

EXAMPLE 9

The procedure of Example 8 was followed with the various component changes as shown in Table I. The result was a strand similar to that of Example 8.

EXAMPLE 10

The procedure of Example 1 was followed with the various component changes as shown in Table I. The result was a plexifilamentary yarn of very fine, continuous white fibers.

EXAMPLE 11

The procedure of Example 5 was followed except that linear low density polyethylene (LDPE) was used instead of high density polyethylene, as shown in Table I. The linear low density polyethylene (melt index of 25) is sold commercially by Dow Chemical Corp., Midland, Mich. as Aspun® 6801. The result was fine, discontinuous plexifilamentary fibers ¼ to ½ inch in length.

EXAMPLE 12

The "1 gallon" autoclave was loaded with 600 g ASPUN® 6801 and 700 g water, then the vessel was closed. The exit manifold of the autoclave was fitted with a spin orifice of 0.035" with a tapered conical entrance at an angle of 120 degrees. A vacuum educator was used to pump the vessel to 20 in. mercury pressure for 15 seconds to remove most of the air but not to significantly remove water. The vessel was then pressurized with carbon dioxide until 1500 g of carbon dioxide had been added, the amount measured with a "Micro-motion" mass flow instrument. Agitation was begun and set to 1000 rpm. Heating of the vessel was begun and continued until the goal temperature of 170° C. was reached. Pressure was adjusted by bleeding small amounts of vapor until the pressure stabilized at 4,500 psi. The mixture was held at 170° C. for 1 minute, the agitator slowed to about 250 rpm and the exit valve promptly opened to permit the mixture to flow to the spin orifice, which had been heated to 210° C. The result was the formation of a finely fibrillated continuous yarn.

EXAMPLE 13

The procedure of Example 12 was used except that the autoclave was loaded with 300 g ASPUN® 6801, 125 g Selar ® OH 4416 ethylene/vinyl alcohol copolymer of melt index 16 (E.I. du Pont de Nemours and Co., Wilmington, Del.), 840 g water, and was charged with 1700 g carbon dioxide. Spinning gave a finely fibrillated continuous yarn very much like that of Example 1 except the yarn is more hydrophilic and has some elastic recovery properties.

EXAMPLE 14

The "300 cc" autoclave was used and operated in the same manner as the "1 gallon" autoclave. Through an addition port, the autoclave was loaded with 30 g Alathon ®/7050 high density linear polyethylene, melt index 17.5, (Occidential Chemical Corporation, Houston, Tex.) and 56 g water. Most of the air was removed from the autoclave by brief evacuation to 20 in. mercury. The autoclave was then pressurized with 146 g carbon dioxide, the agitator set to 2000 rpm and heating begun up to a goal temperature of 170° C. When the goal temperature was reached, the pressure was adjusted by venting small amounts of the mixture to give 4,500 psi. The mixture was then agitated an additional 15 minutes. The exit valve was opened and the mixture spun through the spin orifice. The result was a pulp consisting of finely fibrillated fibers of high quality, ranging from 1/16 to 2 inches in length. The fibers are useful for formation of sheet structures made by known paper making processes.

EXAMPLE 15

The procedure of Example 14 was followed except the autoclave was charged with 15 g Selar ® OH 4416 resin, 15 g ASPUN ® 6801 resin and 56 grams of water. The autoclave was then pressurized with 146 g carbon dioxide. Pressure was 4,700 psi at spinning. A very finely fibrillated continuous yarn, soft and with fibers that are easily separated from the yarn bundle, was produced.

EXAMPLE 16

The procedure of Example 14 was followed, except the autoclave was charged with 30 g ASPUN ® 6801 resin, 15 g Selar ® OH 4416 resin, and 56 g water, and was pressurized with carbon dioxide to a pressure of 3700 psi at spinning. The result was a continuous, finely fibrillated continuous plexifilamentary yarn.

EXAMPLE 17

The procedure of Example 12 was followed, except the autoclave was loaded with 500 g ASPUN ® 6801 resin, 100 g SELAR ® OH 4416 resin, 700 g water and 1300 g carbon dioxide; then the autoclave was heated at 170° C. to a goal pressure of 5,500 psi. The agitator was changed to a multiple high shear paddle/turbine design. High quality continuous finely fibrillated yarn was produced that gave a twisted break tenacity of 1.45 g/denier at 38% elongation.

EXAMPLE 18

Example 17 was re-run under the same conditions but the spinning temperature was increased to 180° C. The yarn was essentially equivalent to Example 17 and measured 1.72 g/denier tenacity at 38.7% elongation. Surface area was measured by the nitrogen absorption technique to be 4.44 $m^2/g$.

EXAMPLE 19

The procedure of Example 1 was followed, except that the charge consisted of 4 g Huntsman 7521 polypropylene (Huntsman Polypropylene Corp., Woodbury, N.J.), an injection molding grade homopolymer of melt flow 3.5 g/10 minutes and melting point of 168° C., 6 g Selar ® OH 4416 ethylene vinyl alcohol copolymer, 43 g ice and 50 g crushed solid carbon dioxide (i.e., dry ice). The autoclave was heated to a goal temperature of 175° C., a pressure of 3,500 psi and agitated at 2,000 rpm for 15 minutes. When the discharge valve was opened, a mass of discontinuous, coarsly fibrillated fibers was obtained.

EXAMPLE 20

The procedure of Example 19 was followed except that the autoclave was charged with 10 g Selar ® OH 4416 resin, 4 g Huntsman 7521 polypropylene resin, 43 g ice and 50 g crushed solid carbon dioxide. A finer fibrillated semi-continuous mass of fibers was made.

EXAMPLE 21

The procedure of Example 12 was followed except that the autoclave was loaded with 300 g Alathon ® 7050, 100 g of "E64179-124-1" (a ethylene vinyl alcohol copolymer to which has been grafted about 10% by weight high density polyethylene), 1200 g carbon dioxide and 500 g distilled water. A slotted spinning nozzle designed to produce a flat rather than cylidrical web shape was used. The goal temperature was 175° C. Otherwise, the procedure was the same as Example 12. The result was the formation of a finely fibrillated continuous yarn that had a twisted tenacity of 4 g/denier, an elongation of 46% and a surface area of 13 $m^2/g$ as measured by the BET method.

"E64179-124-1" is not a commercially available product. It is prepared by taking SELAR ® OH 4416 and modifying it through in situ grafting with high density polyethylene resin that has itself been modified. The high density polyethylene resin was modified in a twin screw extruder through the controlled addition of a peroxide initiator and maleic anhydride. The modified resin is referred to as "HDPE-G-MAN" (high density polyethylene grafted by maleic anhydride addition). The SELAR ® OH 4416 was modified through in situ grafting with the "HDPE-G-MAN" at about 10% by weight in a twin screw extruder at 220° C. The anhydride/hydroxyl reaction provides the grafting site to chemically link up the HDPE and the EVOH.

EXAMPLE 22

The procedure of Example 21 was followed except that 380 g Alathon ®/7050 and 20 g of "64179-124-1" was used. The result was essentially the same as Example 21 except that the resulting yarn was much less hydrophilic and hand sheets made from the yarn exhibited bonding characteristics more like that expected of pure polyethylene yarn.

EXAMPLE 23

The procedure of Example 22 was used except that into the autoclave were loaded 300 g of Shell PP WRS5-675 (polypropylene polymer commercially available from Shell Chemical Company, Short Hills, N.J.), 100 g of "64179-124-5" (a ethylene vinyl alcohol copolymer as described in Example 21 except that to which has been grafted about 20% polypropylene by weight), and 1555 g carbon dioxide. The goal temperature was 200° C. A finely fibrillated 20 inch wide swath was produced that was slightly more coarse that seen when polyethylene was the polymer.

EXAMPLE 24

The procedure of Example 22 was used except that 300 g of "HTX-6133" (a melt spinnable polyurethane polymer (a butylene/poly (alkylene ether) phthalate)), 120 g Alathon®/7050 high density polyethylene and 1715 g carbon dioxide were loaded into the autoclave. The goal temperature was 180° C. A very finely fibrillated yarn was produced with a unique "silky" feel and elastomeric properties.

HTX-6133 is a very soft HYTREL® resin comprised of 77 wt. % soft segment and 23 wt. % hard segment. It is specifically described in the Examples (Preparation of Elastomer A) in U.S. Pat. No. 4,731,407 (Benim et al.), the entire contents of which are incorporated by reference herein.

EXAMPLE 25

The procedure of Example 14 was used except that the autoclave was loaded with 15.5 g of Selar® 4416 ethylene vinyl alcohol copolymer of melt index 16 (commercially available from E.I. du Pont de Nemours and Company, Wilmington, Del.), 15.5 g of Polybond® 1011 acrylic acid graft copolymer with polypropylene of melt index 20 (commercially available from British Petroleum Chemicals, Hackettstown, N.J.), 49 g distilled water and 120 g carbon dioxide. The mixture was stirred at 200° C. and 5000 psi pressure for 15 minutes prior to spinning through a 0.0031 inch spin orifice. A well fibrillated, continuous plexifilamentary yarn was produced.

TABLE 1

| Example # | % EVOH | % Additional Polyolefin | % Surfactant | % H2O | % CO2 | T °C. | Spinning P (psi) |
|---|---|---|---|---|---|---|---|
| 1 | 3.6 | 0 | 0 | 19.8 | 76.6 | 175 | 2500 |
| 2 | 3.6 | 0 | 0 | 19.8 | 76.6 | 175 | 3250 |
| 3 | 3.6 | 0 | 0 | 19.8 | 76.6 | 175 | 2550 |
| 4 | 7.1 | 0 | 0 | 19.6 | 73.3 | 175 | 3300 |
| 5 | 3.6 | 0.5 HDPE | 0 | 19.8 | 76.1 | 175 | 3500 |
| 6 | 3.6 | 1.0 HDPE | 0 | 19.7 | 75.7 | 175 | 3500 |
| 7 | 3.0 | 2.1 HDPE | 0 | 19.7 | 75.2 | 175 | 3500 |
| 8 | 4.4 | 0.4 HDPE | 0.9 | 34.9 | 59.4 | 177 | 3100 |
| 9 | 8.7 | 0 | 0.9 | 35.0 | 55.4 | 173 | 1700 |
| 10 | 9.6 | 0 | 0.1 | 34.7 | 55.6 | 152 | 4900 |
| 11 | 7.1 | 2.0 LDPE | 0 | 19.5 | 71.4 | 175 | 2500 |
| 12 | 0 | 21.4 LDPE | 0 | 25.0 | 53.6 | 170 | 4500 |
| 13 | 4.2 | 10.1 LDPE | 0 | 28.3 | 57.3 | 170 | 4500 |
| 14 | 0 | 12.9 HDPE | 0 | 23.2 | 62.9 | 170 | 4500 |
| 15 | 6.5 | 6.5 LDPE | 0 | 24.1 | 62.9 | 170 | 4700 |
| 16 | 0 | 12.9 LDPE | 0 | 23.2 | 62.9 | 170 | 3700 |
| 17 | 3.8 | 19.2 LDPE | 0 | 26.9 | 50.0 | 170 | 5500 |
| 18 | 3.8 | 19.2 LDPE | 0 | 26.9 | 50.0 | 180 | 5500 |
| 19 | 5.8 | 3.8 PP | 0 | 41.7 | 48.5 | 175 | 3500 |
| 20 | 9.3 | 3.7 PP | 0 | 40.2 | 46.7 | 175 | 3500 |
| 21 | 4.8 | 14.3 HDPE | 0 | 23.8 | 57.1 | 175 | 4500 |
| 22 | 1.0 | 18.1 HDPE | 0 | 23.8 | 57.1 | 175 | 4500 |
| 23 | 4.1 | 12.2 PP | 0 | 20.4 | 63.3 | 200 | 4500 |
| 24 | 11.4* | 4.6 HDPE | 0 | 19.0 | 65.1 | 180 | 4500 |
| 25 | 7.8 | 7.8 PP/AA | 0 | 24.5 | 60.0 | 200 | 5000 |

HDPE = high density polyethylene
LDPE = low density polyethylene
PP = polypropylene
AA = acrylic acid
*Polymer used was polyurethane and not EVOH Although particular embodiments of the present invention have been described in the foregoing description, it will be understood by those skilled in the art that the invention is capable of numerous modifications, spirit or essential attributes of the invention. Reference should be made to the appended claims, rather than to the foregoing specification, as indicating the scope of the invention.

We claim:

1. A process for flash spinning plexifilamentary film-fibril strands of a polymer that is substantially plasticizable in carbon dioxide or water and has a melting point less than 300° C., comprising the steps of:
   (a) forming a spin mixture of water, carbon dioxide and the polymer at a temperature of at least 130° C. and a pressure that is greater than the autogenous pressure of the mixture, the carbon dioxide being present from 30 to 90 percent based on the total weight of the spin mixture; and
   (b) then flash spinning the mixture into a region of substantially lower temperature and pressure.

2. The process of claim 1 wherein the water is present in the range from 5 to 50 percent based on the total weight of the spin mixture.

3. The process of claim 1 wherein the polymer is present in the range from 1.5 to 25 percent based on the total weight of the spin mixture.

4. The process of claim 1 wherein the polymer is selected from the group consisting of polyolefins, polyurethanes, graft copolymers of acrylic acid and combinations thereof.

5. The process of claim 1 wherein the polymer is selected from the group consisting of polypropylene, polyethylene, ethylene vinyl alcohol copolymers and combinations thereof.

6. The process of claim 5 wherein the ethylene vinyl alcohol copolymer has been grafted to between 5–50% by weight high density polyethylene.

7. The process of claim 6 wherein the ethylene vinyl alcohol copolymer has been grafted to about 10% by weight high density polyethylene.

8. The process of claim 1 wherein the spin mixture is formed at a temperature in the range of 130° to 275° C. and a pressure in the range from 1,200 to 6,000 psi.

9. The process of claim 5 wherein the spin mixture comprises ethylene vinyl alcohol copolymer and an additional polymer present in the range from 0 to 25 percent based on the total weight of the spin mixture.

10. The process of claim 9 wherein the additional polymer is selected from the group consisting of polyethylene and polypropylene.

11. The process of claim 1 wherein the spin mixture further comprises a surfactant present in the range from 0 to 2 percent based on the total weight of the spin mixture.

12. The process of claim 9 wherein the ethylene vinyl alcohol copolymer is comprised of at least 20 mole % of ethylene units.

* * * * *